US006118880A

United States Patent [19]

Kokkosoulis et al.

[11] Patent Number: 6,118,880

[45] Date of Patent: Sep. 12, 2000

[54] METHOD AND SYSTEM FOR DYNAMICALLY MAINTAINING AUDIO BALANCE IN A STEREO AUDIO SYSTEM

[75] Inventors: George Kokkosoulis; Daniel Anthony Temple, both of Austin, Tex.

[73] Assignee: International Business Machines Corporation, Armonk, N.Y.

[21] Appl. No.: 09/080,810

[22] Filed: May 18, 1998

[51] Int. Cl.[7] ..... H04R 5/02

[52] U.S. Cl. ..... 381/303; 381/103

[58] Field of Search ..... 381/303, 103, 381/315, 101, 102, 104, 105, 1

[56] References Cited

U.S. PATENT DOCUMENTS

| | | | |
|---|---|---|---|
| 4,435,833 | 3/1984 | Thakkar | 381/109 |
| 4,764,960 | 8/1988 | Aoki et al. | 381/24 |
| 5,386,478 | 1/1995 | Plunkket | 381/103 |
| 5,465,302 | 11/1995 | Lazzari et al. | 381/92 |
| 5,778,087 | 7/1998 | Dunlavy | 381/303 |

*Primary Examiner*—Ping Lee

*Attorney, Agent, or Firm*—Casimer K. Salys; Felsman, Bradley, Vaden, Gunter & Dillon, LLP

[57] ABSTRACT

A method and system for dynamically maintaining audio output balance in a stereo audio system are disclosed. The stereo audio system includes a small hand-held radio frequency remote control and a set of transmitter/receiver control units located at a close proximity to a respective speaker. For example, the stereo audio system may have six transmitter/receiver control units: one at a front-left speaker, one at a front-right speaker, one at a rear-left speaker, one at a rear-right speaker, a center speaker, and a sub-woofer. The stereo audio system is able to make audio balance adjustment for simulating a stereo headphone effect based on the physical position of the listener, throughout the entire listening area.

7 Claims, 3 Drawing Sheets

METHOD AND SYSTEM FOR DYNAMICALLY MAINTAINING AUDIO BALANCE IN A STEREO AUDIO SYSTEM

BACKGROUND OF THE INVENTION

1. Technical Field

The present invention relates to an audio system control in general, and in particular to a method and system for controlling audio output of an audio system. Still more particularly, the present invention relates to a method and system for dynamically maintaining audio output balance in a stereo audio system.

2. Description of the Prior Art

In recent years, there have been numerous technological improvements in home theater systems in order to provide a home audience with a theater-quality video presentation at their own home. In addition to a well-equipped video system, such as a digital versatile disk (DVD) drive and a wide-screen television, a typical home theater system also includes a sophisticated audio system, which may include a surround sound™ audio system, so that the home audience can experience various sound effects from a movie presented by the home theater system as if the home audience were in a theater.

Generally speaking, headphones provide a listener with the best balance between audio output from the left and right stereo channels because the headphones are located a constant distance from the listener's ear drums, regardless of any change in the listener's physical location. When listening to audio output produced by conventional speakers, on the other hand, the listener has to be located equidistant from the left and right stereo channel speakers in order to maintain a true stereo balance. Otherwise, even for the most sophisticated audio system, the listener still has to manually adjust an audio balance control on the system in order to obtain a center-stage, headphone-like sonic image. This disclosure provides a method for automatically performing all adjustments necessary to furnish the listener with a true stereo balance between audio channels, regardless the physical location of the listener.

SUMMARY OF THE INVENTION

In view of the foregoing, it is therefore an object of the present invention to provide an improved method and system for an audio system control.

It is another object of the present invention to provide an improved method and system for controlling audio output of an audio system.

It is yet another object of the present invention to provide an improved method and system for dynamically maintaining audio output balance in a stereo audio system.

In accordance with a method and system of the present invention, a stereo audio system includes a base unit and multiple speakers. A separate control unit is utilized to couple each speaker to the base unit. A listener then indicates his/her physical position with respect to all of the control units via a remote control capable of sending radio frequency signals. Based on the time required for the radio frequency signals to travel between the remote control and each of the control units, the location of the remote control with respect to each of the control units is determined. Finally, the audio output of each of the speakers is individually adjusted according to location of the remote control with respect to each of the control units, such that an audio output having a true stereo balance can be delivered to the listener.

All objects, features, and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
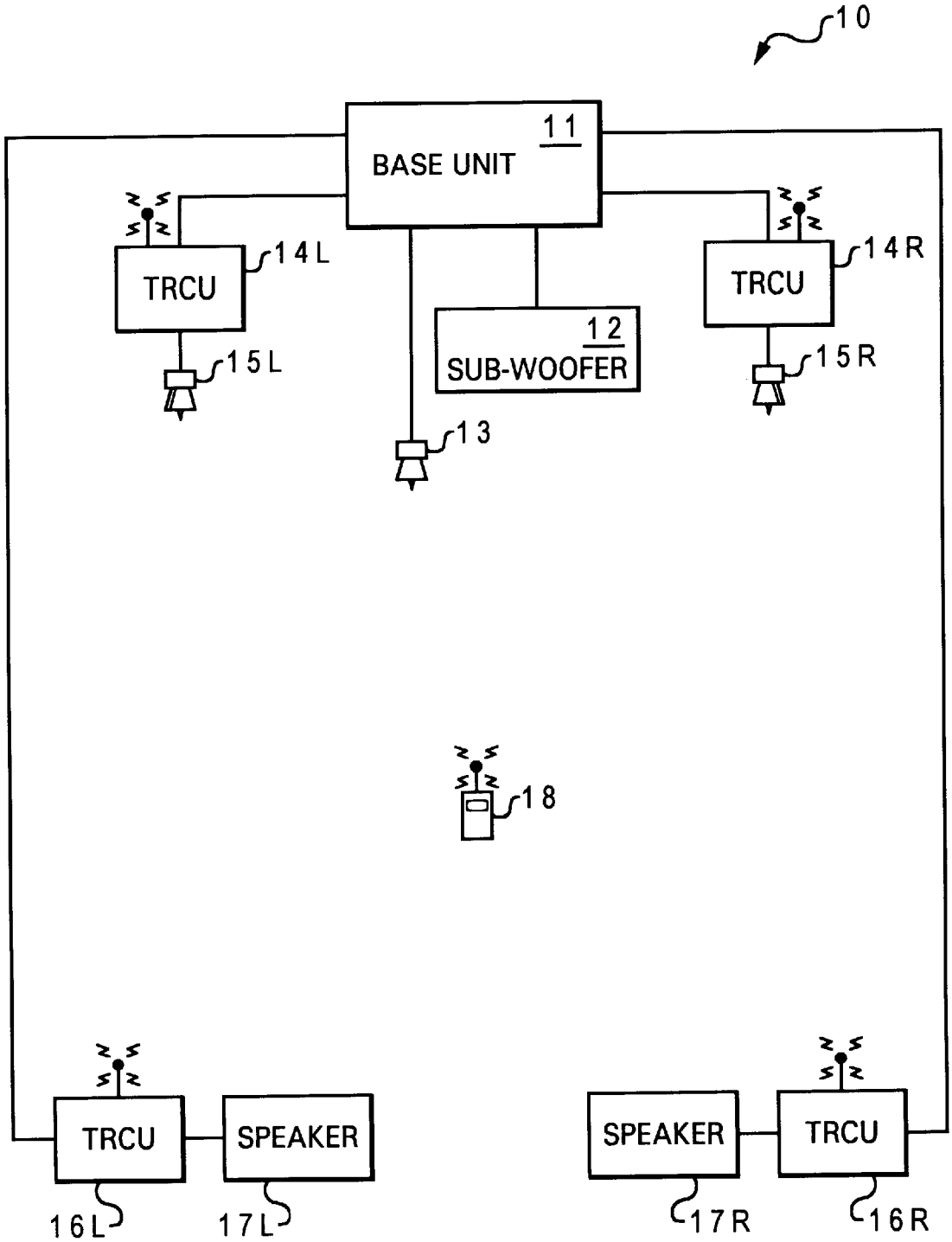
FIG. 1 is a block diagram of a stereo audio system in which a preferred embodiment of the present invention can be implemented.

Referring now to the drawings and in particular to FIG. 1, there is depicted a block diagram of a stereo audio system in which a preferred embodiment of the present invention can be implemented. As shown, the central component of a stereo audio system 10 is a base unit 11 that includes, inter alia, a pre-amplifier and a bass amplifier, which are well-known in the art. Base unit 11 is coupled to a center channel speaker 13 and a sub-woofer 12. In addition, base unit 11 is coupled to a left-front speaker 15L via a left-front transmitter/receiver control unit (TRCU) 14L, and a right-front speaker 15R via a right-front TRCU 14R. Further, base unit 11 is also coupled to a left-rear speaker 17L via a left-rear TRCU 16L, and to a right-rear speaker 17R via a right-rear TRCU 16R. TRCU 14L and TRCU 14R are in close proximity with left-front speaker 15L and right-front speaker 15R, respectively. Similarly, TRCU 16L and TRCU 16R are in close proximity with left-rear speaker 17L and right-rear speaker 17R, respectively.

Preferably, center channel speaker 13, left-front speaker 15L, and right-front speaker 15R are speakers (or tweeters) designed to output relatively high-pitch (i.e., treble) audio signals. On the other hand, sub-woofer 12 is designed to output relatively low-pitch (i.e., bass) audio signals. Left-rear speaker 17L and right-rear speaker 17R are speakers preferably designed to output audio signals with a surround sound™ effect.

As a preferred embodiment of the present invention, a small hand-held remote control 18 may be utilized to signal its physical position with respect to TRCU 14L, TRCU 14R, TRCU 16L, and TRCU 16R of audio system 10, such that the audio output from each of speakers 15L, 15R, 17L, and 17R can be automatically adjusted to deliver stereo-balanced audio output to the listener who is holding remote control 18.

Remote control 18 is preferably a radio frequency (RF) transmitter/receiver capable of transmitting RF signals to and receiving RF signals back from each of TRCU 14L, TRCU 14R, TRCU 16L, and TRCU 16R individually. The frequency for the transmission is preferably approximately 900 MHz, with a frequency shift keying (FSK) scheme being utilized to represent the binary information. FSK scheme can be accomplished through the use of a voltage controlled oscillator, as is well-known in the art. The binary information is transmitted in an eight-bit format, in which the first four bits are hard-coded in a transmission device, regardless of whether the transmission device is one of TRCUs 14L, 14R, 16L, and 16R or remote control 18. Among these first four bits, the first bit is preferably a logical "1" followed by a three-bit component identification. The last four bits are user defined, mainly for the purpose of avoiding interference with other radio frequency sources having similar transmission frequencies. Thus, the last four bits should be set identical for all transmission devices within the same stereo audio system.

Accordingly, in addition to a main button for initiating the transmission and balance adjustment sequence, remote control 18 also includes a set of switches for the listener to select the last four bits of the transmission bit pattern. By the same token, each of TRCUs 14L, 14R, 16L, and 16R also includes one set of switches like that of remote control 18. Remote control 18 may also include other features such as LEDs for indicating transmission progress and battery condition.

All TRCUs have audio-in ports and audio-out ports that can be serially coupled between base unit 11 and a speaker, such as one of speakers 15L, 15R, 17L, and 17R. In this exemplary implementation, audio output balance changes are not made at the balance control on base unit 11 itself. Instead, the audio output balance is adjusted by the TRCUs relative to the balance control on base unit 11 utilizing a variable voltage divider.

Figure 2:
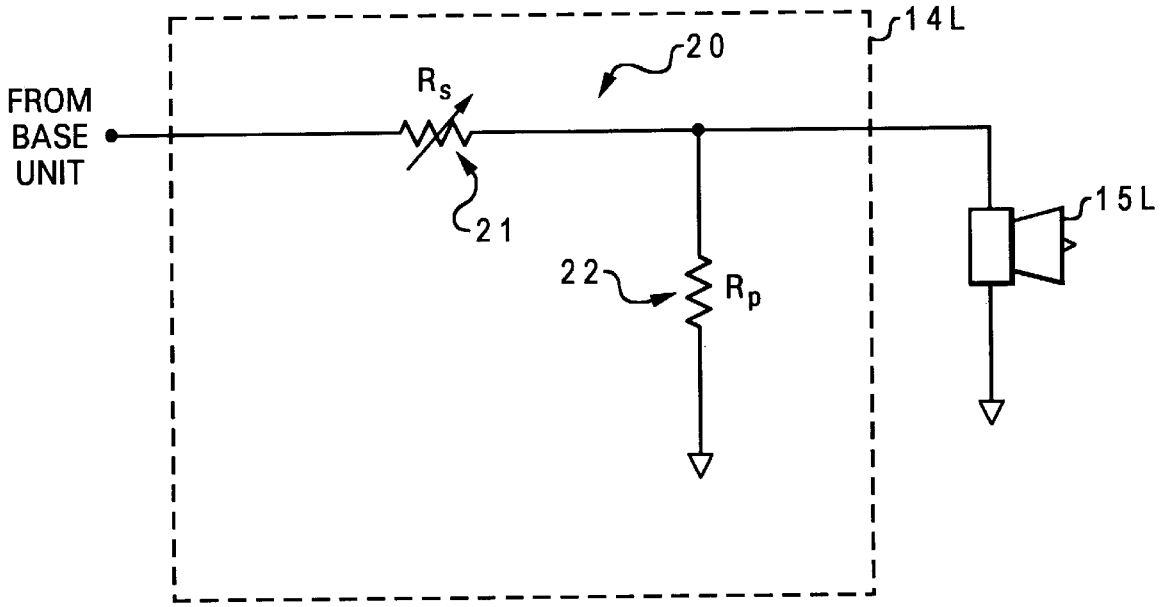
FIG. 2 is a circuit diagram of a variable voltage divider within a transmitter/receiver control unit, in accordance with a preferred embodiment of the present invention.

With reference now to FIG. 2, there is illustrated a circuit diagram of a variable voltage divider within a TRCU, in accordance with a preferred embodiment of the present invention. As shown, a variable voltage divider 20 includes a variable resistor (or series resistor) 21 and a fixed resistor (or parallel resistor) 22, with variable resistor 21 preferably being a digitally controlled variable resistor. The amplitude of an audio output delivered to a speaker, such as speaker 15L for example, can be controlled by variable voltage divider 20. In addition, it is preferable that the resistance of variable resistor 21 can be controlled according to a logarithmic scale, so that the resistance may correspond with the response of human ears to sound intensity.

Within variable voltage divider 20, the resistance of parallel resistor 22 should be small enough so that nearly all signal power will be transferred from the output of the base unit to speaker 15L when the resistance of series resistor 21 is at a minimum. However, when the resistance of series resistor 21 is at its maximum, most of the output power from the base unit will be dissipated within series resistor 21, making the amplitude of the audio output of speaker 15L much less than the amplitudes of the audio outputs of other speakers within the stereo audio system.

As one of the many objects of the present invention, listener location detection is probably the most complicated function of stereo audio system 10. If stereo audio system 10 is placed within a typical living room, a listener is somewhere between one and twenty feet from any given TRCU. Hence, the time of flight of one single RF transmission over this range of distances is in the range of 1.5 ns to 20 ns, making it nearly impossible to determine any meaningful distinctions between flight times of individual RF transmissions. High-precision time difference detection of this type typically requires extremely accurate components that are prohibitively expensive for use in consumer electronics. Hence a different technique is utilized to perform listener location detection in the present invention. It is observed that if multiple RF signals are sent back and forth between remote control 18 and each of the TRCUs, the calculation of a time difference would be much more manageable because one thousand transmissions, for example, have a cumulative flight time in the range of 1.5 $\mu$s to 20 $\mu$s.

Figure 3:
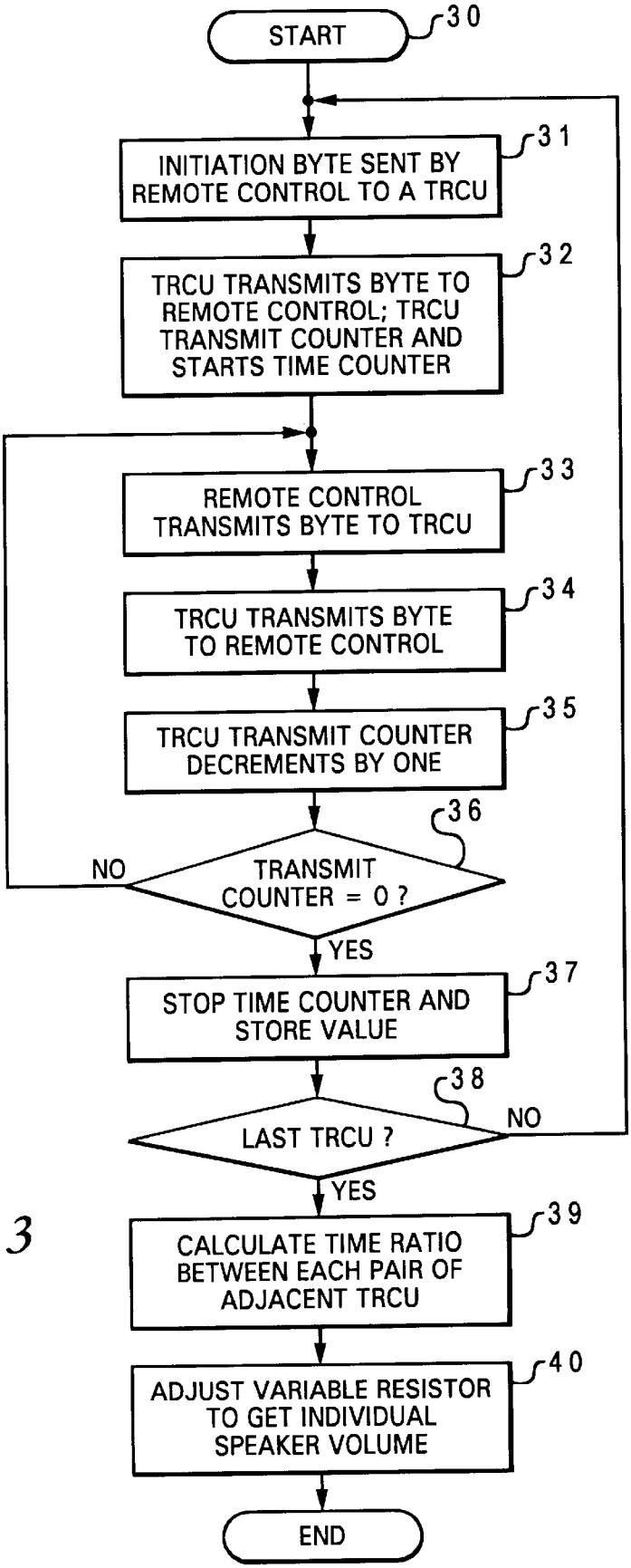
FIG. 3 is a high-level logic flow diagram of a method of performing listener location detection for dynamically maintaining audio output balance in a stereo audio system, in accordance with the preferred embodiment of the present invention.

Referring now to FIG. 3, there is depicted a high-level logic flow diagram illustrating a method of performing listener location detection for dynamically maintaining audio output balance in a stereo audio system, in accordance with the preferred embodiment of the present invention. Starting at block 30, a transmission sequence is initiated by a listener with a remote control 18. As part of the initiation process, remote control 18 sends out one byte of data (an initiation byte) to a specific TRCU, as shown in block 31. The initiation byte preferably includes a leading "1" followed by a three-bit component identification of the specific TRCU, and a four-bit user-defined code, as described previously. The transfer of the initiation byte occurs only once per TRCU, and is not considered as part of the transmit/receive cycle described below. After this single initiation byte has been received by the specific TRCU, the specific TRCU then sends an acknowledgement byte back to remote control 18, sets a value in a transmit counter within the specific TRCU, and starts a time counter, as depicted in block 32.

After remote control 18 receives the acknowledgement byte, remote control 18 then transmits the byte back to the specific TRCU again, as illustrated in block 33. In return, the specific TRCU transmits the byte back to remote control 18, as shown in block 34. This completes one entire transmit/receive cycle, causing the transmit counter within the specific TRCU to be decremented by one, as shown in block 35. This transmit/receive cycle will repeat until the transmit counter within the specific TRCU reaches zero. If the transmit counter within the specific TRCU has not yet reached zero, the process returns to block 33.

After a predetermined number (e.g., 1000) of transmit/receive cycles, the transmit counter will reach zero. At this point, the time counter within the specific TRCU is stopped, and the value of the time counter is stored, as shown in block 37. If there are more TRCUs within stereo audio system 10 that need to be polled, the process then returns back to block 31. After remote control 18 initiates an initiation byte, a next TRCU will proceed with the same transmit/receive sequence, as described in blocks 33–35.

After the last TRCU within stereo audio system 10 has completed its transmit/receive sequence with remote control 18, each TRCU within stereo audio system 10 communicates its time counter value to the other TRCU in its adjacent pair, and each TRCU then calculates a time ratio individually, as depicted in block 39. Using stereo audio system 10 in FIG. 1 as an example, the value of the series resistor within each of TRCUs 14L, 14R, 16L, and 16R can be calculated by the following equations:

For 14L, $$R_s = \frac{1}{2}\left[\frac{t_2}{t_1} + \frac{t_3}{t_1}\right] - 1 \tag{1}$$

For 14R, $$R_s = \frac{1}{2}\left[\frac{t_1}{t_2} + \frac{t_4}{t_2}\right] - 1 \tag{2}$$

For 16L, $$R_s = \frac{1}{2}\left[\frac{t_1}{t_3} + \frac{t_4}{t_3}\right] - 1 \quad (3)$$

For 16R, $$R_s = \frac{1}{2}\left[\frac{t_3}{t_4} + \frac{t_2}{t_4}\right] - 1 \quad (4)$$

where $t_1$ is the cumulative flight time between TRCU 14L and remote control 18, $t_2$ is the cumulative flight time between TRCU 14R and remote control 18, $t_3$ is the cumulative flight time between TRCU 16L and remote control 18, and $t_4$ is the cumulative flight time between TRCU 16R and remote control 18. Each cumulative flight time is represented by the stored time counter value obtained from block 37. In this example, equations (1) and (3) are for the left channel, while equations (2) and (4) are for the right channel of stereo audio system 10.

Finally, the variable resistor within each TRCU are adjusted accordingly, as illustrated in block 40. Thus, by locating the listener's physical position and then making resistor adjustments based on time ratio calculations, an audio output having true stereo balance can be delivered to the listener.

For the initiation sequence and the subsequent transmit/receive sequence, there are four error conditions that may exist at either remote control 18 or one of the TRCUs: (1) no return data is received; (2) return data is received after a designated time; (3) incorrect data is returned; and (4) incorrect data is returned after a designated time. For each of the above-mentioned error conditions, stereo audio system 10 is programmed to immediately stop the current transmit/receive sequence for a TRCU at which the problem occurred, and start over only for that TRCU.

As has been described, the present invention provides a method and system for dynamically maintaining audio output balance in a stereo audio system. The present invention is applicable to a home stereo, a personal computer system having a multimedia feature, or even in a public announcement environment. Although a six-channel home theater system such as an MPEG-2 Dolby Digital™ system is utilized to illustrate the present invention, the principle as disclosed can easily be implemented in the more common two-channel stereo systems.

While the invention has been particularly shown and described with reference to a preferred embodiment, it will be understood by those skilled in the art that various changes in form and detail may be made therein without departing from the spirit and scope of the invention.

What is claimed is:

1. A method for dynamically maintaining audio output balance in a stereo audio system, wherein said stereo audio system includes a base unit and at least four speakers, said method comprising the steps of:

coupling a first control unit between a first of said at least four speakers and said base unit;

coupling a second control unit between a second of said at least four speakers and said base unit;

coupling a third control unit between a third of said at least four speakers and said base unit;

coupling a fourth control unit between a fourth of said at least four speakers and said base unit, wherein each of said control units is positioned in close proximity to each of said respective speakers;

indicating a physical position of a listener with respect to all of said control units via a remote control;

determining a relative distance of said remote control with respect to each of said control units; and adjusting audio output of each of said plurality of speakers by adjusting a value of a variable resistor within each of said control units, wherein said value of said variable resistor within each of said control units, $R_s$, is adjusted as follows:

for said first control unit, $$R_s = \frac{1}{2}\left[\frac{t_2}{t_1} + \frac{t_3}{t_1}\right] - 1$$

for said second control unit, $$R_s = \frac{1}{2}\left[\frac{t_1}{t_2} + \frac{t_4}{t_2}\right] - 1$$

for said third control unit, $$R_s = \frac{1}{2}\left[\frac{t_1}{t_3} + \frac{t_4}{t_3}\right] - 1$$

for said fourth control unit, $$R_s = \frac{1}{2}\left[\frac{t_3}{t_4} + \frac{t_2}{t_4}\right] - 1$$

where $t_1$ is a cumulative flight time between said first control unit and said remote control, $t_2$ is a cumulative flight time between said second control unit and said remote control, $t_3$ is a cumulative flight time between said third control unit and said remote control, and $t_4$ is a cumulative flight time between said fourth control unit and said remote control, so that true stereo balance audio is obtained at said physical position.

2. The method according to claim 1, wherein said indicating step is performed by sending radio frequency signals.

3. The method according to claim 1, wherein said determining step is performing by measuring a time required for transmitting a signal back and forth between said remote control and each of said control units.

4. A stereo audio system capable of dynamically maintaining audio output balance, wherein said stereo audio system includes a base unit and at least four speakers, said stereo audio system comprising:

a first control unit coupled between a first of said at least four speakers and said base unit, a second control unit coupled between a second of said at least four speakers and said base unit, a third control unit coupled between a third of said at least four speakers and said base unit, and a fourth control unit coupled between a fourth of said at least four speakers and said base unit, wherein each of said control units is positioned in close proximity to each of said respective speakers;

a remote control for indicating a physical position of a listener with respect to all of said control units;

means for determining a relative distance of said remote control with respect to each of said control units; and means for adjusting audio output of each of said plurality of speakers by adjusting a value of a variable resistor within each of said control units, wherein said value of said variable resistor within each of said control units, $R_s$, is adjusted as follows:

for said first control unit, $$R_s = \frac{1}{2}\left[\frac{t_2}{t_1} + \frac{t_3}{t_1}\right] - 1$$

for said second control unit, $$R_s = \frac{1}{2}\left[\frac{t_1}{t_2} + \frac{t_4}{t_2}\right] - 1$$

for said third control unit, $$R_s = \frac{1}{2}\left[\frac{t_1}{t_3} + \frac{t_4}{t_3}\right] - 1$$

for said fourth control unit, $$R_s = \frac{1}{2}\left[\frac{t_3}{t_4} + \frac{t_2}{t_4}\right] - 1$$

where $t_1$ is a cumulative flight time between said first control unit and said remote control, $t_2$ is a cumulative flight time between said second control unit and said remote control, $t_3$ is a cumulative flight time between said third control unit and said remote control, and $t_4$ is a cumulative flight time between said fourth control unit and said remote control, so that true stereo balance audio is obtained at said physical position.

5. The audio system according to claim 4, wherein said remote control utilizes radio frequency signals to indicate a physical position of a listener with respect to all of said control units.

6. The audio system according to claim 4, wherein said determining means measures a time required for transmitting a signal back and forth between said remote control and each of said control units.

7. The audio system according to claim 4, wherein said adjusting means is a variable voltage divider.

* * * * *